US012479621B2

(12) United States Patent
Tomooka et al.

(10) Patent No.: US 12,479,621 B2
(45) Date of Patent: Nov. 25, 2025

(54) PACKAGING BOX BODY, INFORMATION PROCESSING APPARATUS, AND PROGRAM

(71) Applicant: Rakuten Group, Inc., Tokyo (JP)

(72) Inventors: Takashi Tomooka, Tokyo (JP); Mitsuru Nakazawa, Tokyo (JP)

(73) Assignee: Rakuten Group, Inc., Tokyo (JP)

( * ) Notice: Subject to any disclaimer, the term of this patent is extended or adjusted under 35 U.S.C. 154(b) by 0 days.

(21) Appl. No.: 18/188,829

(22) Filed: Mar. 23, 2023

(65) Prior Publication Data

US 2023/0303288 A1 Sep. 28, 2023

(30) Foreign Application Priority Data

Mar. 28, 2022 (JP) ..... 2022-052613

(51) Int. Cl.
*B65D 5/42* (2006.01)

(52) U.S. Cl.
CPC ..... *B65D 5/4216* (2013.01); *B65D 2203/06* (2013.01)

(58) Field of Classification Search
None
See application file for complete search history.

(56) References Cited

U.S. PATENT DOCUMENTS

| | | | | |
|---|---|---|---|---|
| 9,142,035 | B1 * | 9/2015 | Rotman | G07B 17/00661 |
| 11,743,415 | B2 * | 8/2023 | Nakayama | G06Q 10/083 345/633 |
| 2018/0114228 | A1 * | 4/2018 | Singh | G07G 1/0063 |
| 2019/0156316 | A1 * | 5/2019 | Simske | G07G 1/0045 |
| 2021/0107750 | A1 * | 4/2021 | Iino | B25J 19/023 |

FOREIGN PATENT DOCUMENTS

| | | |
|---|---|---|
| JP | 3-39771 U | 4/1991 |
| JP | 2020-107139 A | 7/2020 |
| WO | 2019/093328 A1 | 5/2019 |

OTHER PUBLICATIONS

Xiao et al ("Localizing 3D cuboids in single-view images." Advances in neural information processing systems 25, 2012, pp. 1-9) (Year: 2012).*

* cited by examiner

*Primary Examiner* — Leon Viet Q Nguyen
(74) *Attorney, Agent, or Firm* — Sughrue Mion, PLLC

(57) ABSTRACT

Disclosed is a packaging box body for packing an article. In the packaging box body, an upper surface and at least two lateral surfaces that are adjacent to each other are defined as target surfaces, and a code image is formed on each of the target surfaces.

5 Claims, 7 Drawing Sheets

PACKAGING BOX BODY, INFORMATION PROCESSING APPARATUS, AND PROGRAM

CROSS REFERENCE TO RELATED APPLICATIONS

This non-provisional application claims priority under 35 U.S.C. § 119(a) on Patent Application No. 2022-052613 filed in Japan on Mar. 28, 2022, the entire contents of which are hereby incorporated by reference.

BACKGROUND

The present disclosure relates to a packaging box body, an information processing apparatus, and a computer readable medium.

In recent years, a generally-called consumer to consumer (C2C) market place service which mediates selling and buying of products between users, have been widely used. In order to lessen a burden on a seller to ship a product, Japanese Patent Laid-Open No. 2020-107139 discloses a technology of acquiring product size information which indicates the size of a product by object measuring means using an image taken by an imaging device, and transmitting package information that includes the acquired product size information and/or packing material size information which indicates the size of a packing material based on the product size information, to another information processing apparatus.

SUMMARY

However, in the above related technology, a measured size is used to specify the size of a packaging material, for example. Thus, the measured size is used to make a contribution to the seller-side convenience. Even if a purchase requester is informed of the size, the purchase requester cannot confirm whether there is a measurement error or whether the measured object will be actually sold. This has presented a problem that support for the assurance of shipping of a product that the seller actually has in hand is not sufficiently taken into consideration.

The present disclosure has been made in view of the above circumstances, and it is desirable to provide a packaging box body, an information processing apparatus, and a computer readable medium for helping a purchase requester participate safely in an e-commerce from a viewpoint of the purchase requester.

According to one aspect of the present disclosure, there is provided a packaging box body for packing an article, in which an upper surface and at least two lateral surfaces that are adjacent to each other are defined as target surfaces, and a code image is formed on each of the target surfaces.

According to another aspect of the present disclosure, there is provided a packaging box body for packing an article, in which an inner bottom surface and at least two inner lateral surfaces that are adjacent to each other are defined as target surfaces, and a code image is formed on each of the target surfaces.

According to still another aspect of the present disclosure, there is provided an information processing apparatus including an imaging section for capturing an image that includes a packaging box body and an article, and an estimation section for estimating, on the basis of the captured image, a size of the article included in the captured image, in which information regarding the estimated size of the article is applied to a prescribed process concerning trading of the article.

According to further another aspect of the present disclosure, there is provided a computer readable medium which stores a program for causing a computer to function as an imaging section for capturing an image that includes a packaging box body and an article, an acquisition section for acquiring information about a size of the packaging box body, and an estimation section for estimating a size of the article included in the captured image on the basis of the acquired information about the size of the packaging box body and the captured image, the program being configured to apply information regarding the estimated size of the article, to a prescribed process concerning trading of the article.

According to the present disclosure, a process for helping a purchase requester participate safely in an e-commerce from the viewpoint of the purchase requester is performed.

DETAILED DESCRIPTION OF THE PREFERRED EMBODIMENT

Hereinafter, an embodiment of the present disclosure will be explained with reference to the drawings. It is to be noted that shapes and sizes of parts and a ratio thereamong in the following explanation and the drawings are examples, and thus, a design change thereof can be made, as appropriate.

Figure 1:
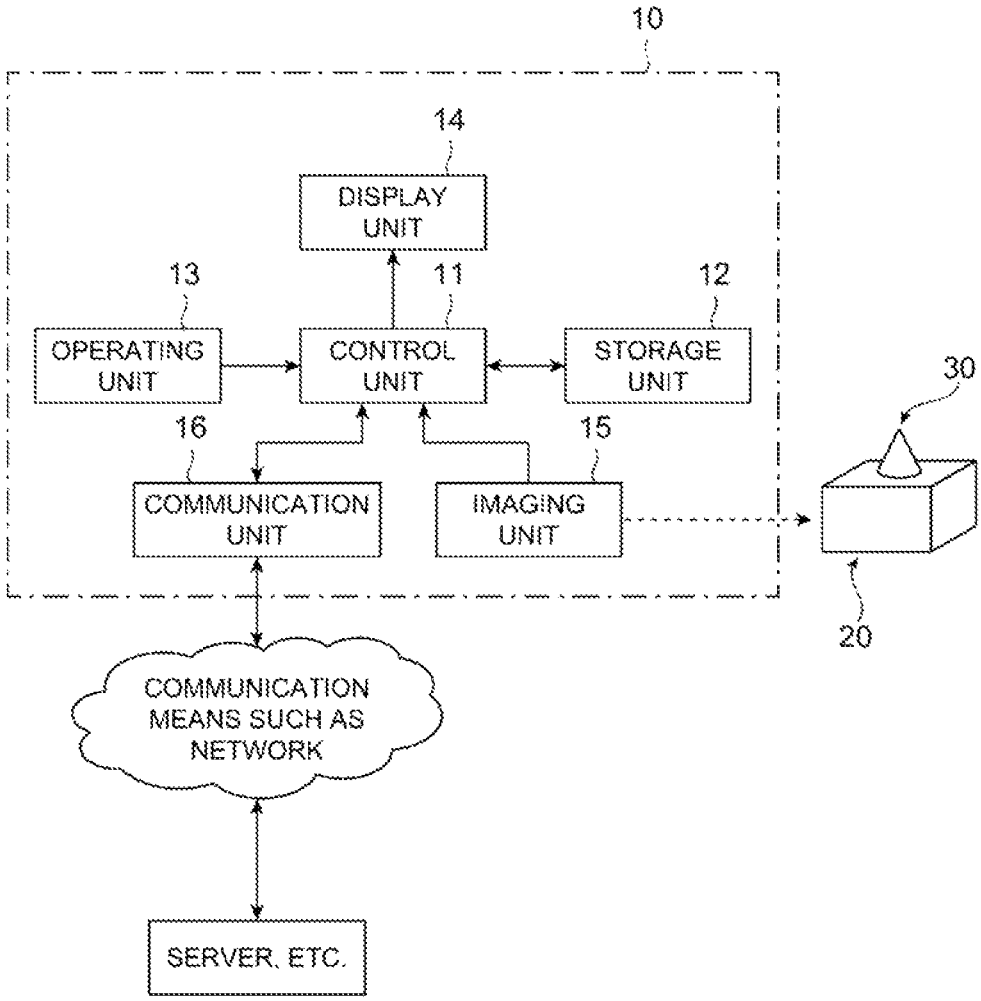
FIG. 1 is a configuration block diagram of an information processing apparatus according to an embodiment of the present disclosure.

An information processing apparatus 10 according to an embodiment of the present disclosure is a smartphone, a tablet terminal, or a personal computer, for example. As depicted in FIG. 1, the information processing apparatus 10 includes a control unit 11, a storage unit 12, an operating unit 13, a display unit 14, an imaging unit 15, and a communication unit 16.

Figure 2:
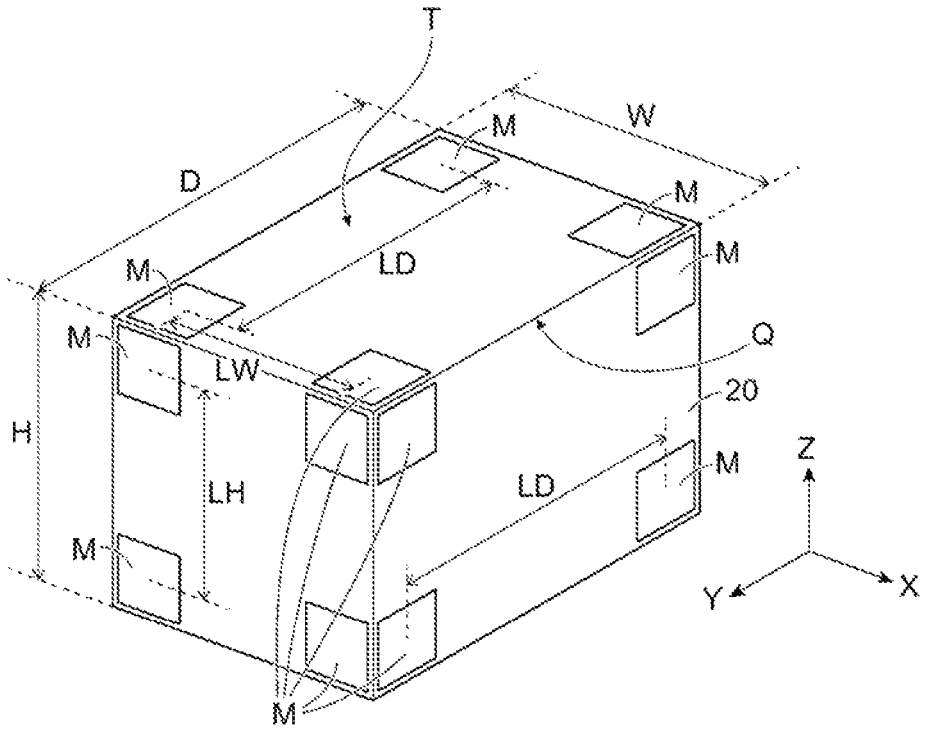
FIG. 2 is a schematic perspective view of a packaging box body according to the embodiment of the present disclosure.
Figure 3:
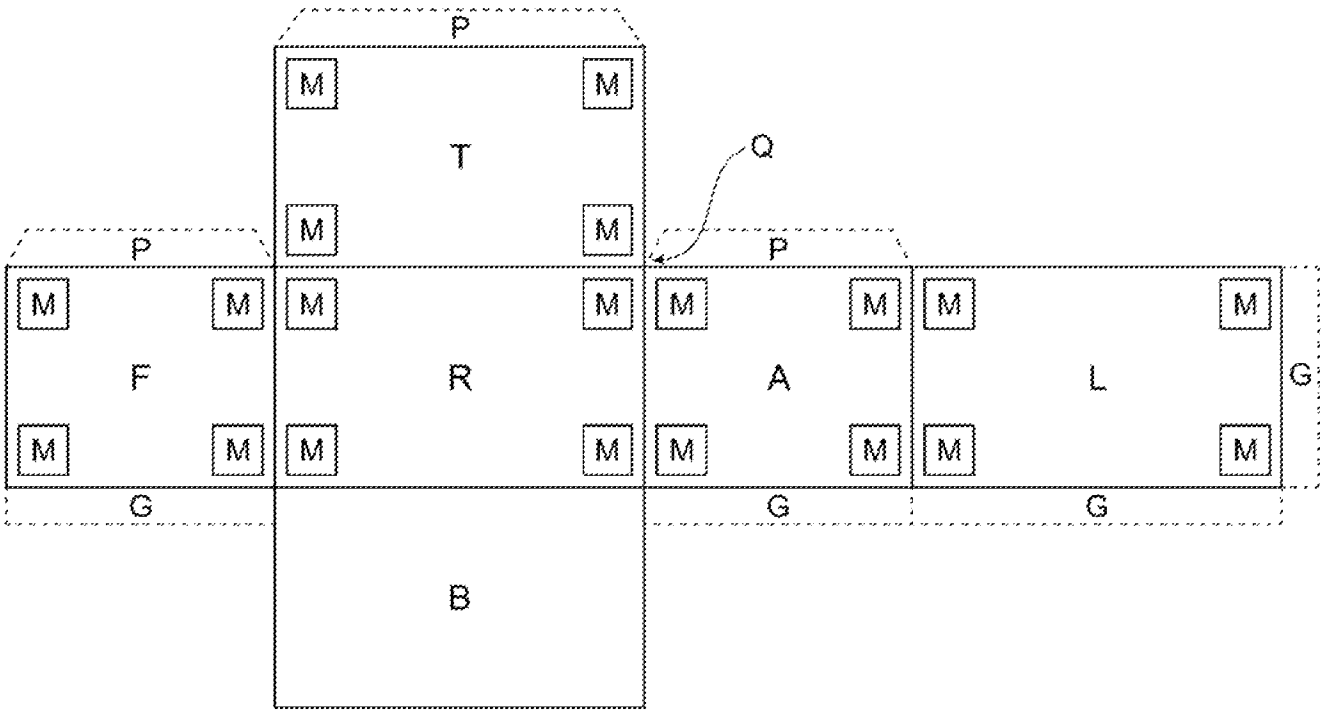
FIG. 3 is a developed view of an example of the packaging box body according to the embodiment of the present disclosure.
Figure 4:
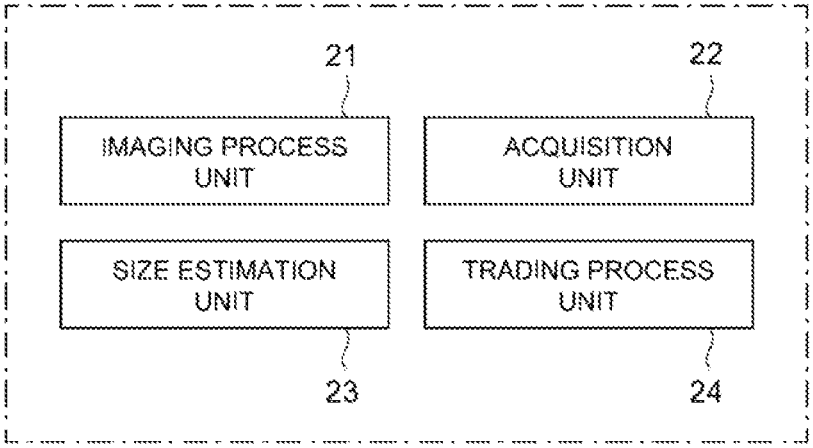
FIG. 4 is a functional block diagram of an example of the information processing apparatus according to the embodiment of the present disclosure.

Further, the present embodiment uses a packaging box body 20 which is depicted in FIGS. 2 and 3. FIG. 2 is a schematic perspective view of the packaging box body 20. FIG. 3 is a developed view of a front surface side of the packaging box body 20. The packaging box body 20 may be formed by folding one plate material depicted in the developed view in FIG. 3 along prescribed lines so as to form surfaces, and by fixing the adjacent surfaces together with use of an adhesive or with the surfaces inserted in slits that are formed in the plate material. The plate material is a corrugated cardboard plate, for example. Moreover, margins G and flaps P (which are indicated by broken lines in the drawing) for bonding the surfaces may be formed on the plate material.

The formed packaging box body 20 depicted in FIGS. 2 and 3 has a hexahedron (cuboid) shape. One (upper surface T in FIGS. 2 and 3) of the surfaces of the packaging box body 20 is a cover that is openable/closable along a fold line Q. When opening the cover surface, a user can access the inside of the packaging box body 20.

One feature of the present embodiment is that the upper surface T of the packaging box body 20 and at least two lateral surfaces thereof adjacent to each other are defined as target surfaces and a code image M is formed on each of the target surfaces. The code image M is a computer readable bar code, or more preferably, is a two-dimensional bar code that has a prescribed area, for example.

In a certain example of the present embodiment, the code images M are formed around two or more corners of each of the target surfaces, as depicted in FIG. 3. That is, the code images M are formed in such a way that the distance from each of the two or more corners to the closest code image M is sufficiently shorter than a half of the length of a side including the corners of the target surface. In this example, a plurality (at least two) of the code images M are formed on each of the target surfaces.

Moreover, the code image M is formed by encoding at least one of the followings.

(A) size information indicating the real size of the packaging box body 20 with the code images M (information for identifying a width W, a depth D, and a height H of the packaging box body 20), (B) distance information indicating the distance between the code images M (real distances LW, LD, LH), if a plurality of the code images M are disposed, (C) code size information identifying the size (longitudinal and lateral lengths) of the code image M itself, and (D) identification information unique to the packaging box body 20.

(A) to (D) are just examples, and the encoded information may include any other information.

Hereinafter, size and distance information (e.g. the above information (A), (B), and (C)) that can be used to estimate the size of the packaging box body 20 and the size of an article packed in the packaging box body 20 is referred to as measurement reference information.

Further, in order to indicate that the packaging box body 20 is a genuine packaging box body, information concerning an electronic signature may be included in the code image M. The electronic signature is encrypted information (e.g. a hash value), a plaintext of which is identification information (BID) unique to the packaging box body 20, for example. The electronic signature may be generated by encrypting the plaintext with a secret key that is managed by, for example, a manager of an external server. By communicating with the external server through communication means (e.g. a network), the information processing apparatus 10 may verify the electronic signature indicated by the code image M. In a case where the verification result depicts that the packaging box body 20 is a genuine packaging box body, the information processing apparatus 10 may subsequently estimate the size of the article 30 based on an imaging process on the code image M.

Next, the operation of the units in the information processing apparatus 10 will be explained. The control unit 11 of the information processing apparatus 10 is a program control device such as a central processing unit (CPU), and operates in accordance with a program stored in the storage unit 12. In one example of the present embodiment, the control unit 11 acquires, by image capturing, an image that includes the packaging box body 20 and the article 30 which is an object of trading to be packed in the packaging box body 20 and acquires information about the size of the packaging box body 20. The control unit 11 estimates the size of the article 30 included in the captured image, on the basis of the acquired information about the size of the packaging box body and the captured image, and applies information regarding the estimated size of the article 30 to a prescribed process concerning trading of the article 30. A detailed description of the process in the control unit 11 will be given later.

The storage unit 12 is a memory device, for example, and holds a program which is executed by the control unit 11. Further, the storage unit 12 also serves as a work memory for the control unit 11. In the present embodiment, the program may be provided in a state of being stored in a computer readable and non-transitory recording medium, and then, be stored into the storage unit 12. The operating unit 13 is a touch panel, a mouse, or a keyboard, for example. The operating unit 13 receives a user operation, and outputs information indicating the user operation to the control unit 11.

The display unit 14 is a display, for example. The display unit 14 displays information in accordance with a command inputted from the control unit 11. Further, in accordance with a command inputted from the control unit 11, an image captured by the imaging unit 15 is displayed on the display unit 14. The imaging unit 15 is a camera, for example. The imaging unit 15 outputs, to the control unit 11, image data acquired by sequentially capturing images having a prescribed angle of view in the visual direction. The imaging unit 15 may be a monocular camera or may be a compound eye camera (stereo camera). The information processing apparatus 10 may further include a detection unit such as a depth camera (depth sensor). A method for determining the size of the article 30, which will be described later, may be adopted from among known or common methods, according to the forms of the imaging unit 15 and the detection unit.

The communication unit 16 is a wired or wireless network interface, for example. The communication unit 16 outputs data received over a network, to the control unit 11. Further, in accordance with a command inputted from the control unit 11, the communication unit 16 transmits designated data to a designated destination over the network.

Here, operation of the control unit 11 of the information processing apparatus 10 will be explained. The control unit 11 according to one example of the present embodiment executes the program stored in the storage unit 12, whereby a configuration functionally including an imaging process unit 21, an acquisition unit 22, a size estimation unit 23, and a trading process unit 24 is implemented.

The imaging process unit 21 sequentially receives image data captured by the imaging unit 15, and outputs the received image data to the acquisition unit 22. In the present embodiment, a user of the information processing apparatus 10 performs image capturing such that the packaging box body 20 and the article (an object of the commerce) 30 which is to be packed in the packaging box body 20 and be shipped are included in one screen.

The acquisition unit 22 detects, from the image data sequentially received by the imaging process unit 21, a feature point group on the captured subjects (the packaging box body 20 and the article 30). By using the feature point group, the acquisition unit 22 further detects the packaging box body 20 (a relatively large hexahedron) and the article 30 from the image data acquired as a result of the image capturing. The acquisition unit 22 can acquire information about the size of the article 30 by a prescribed three-dimensional measurement process. A known technology can be used to perform the three-dimensional measurement process, and thus, a detailed explanation thereof will be omitted. In one example, the acquisition unit 22 may adopt, as a method for the three-dimensional measurement process, a known technology such as that described in Jun SATO, "Computer vision—geometry of vision—," Corona Co., LTD. (1999).

The acquisition unit 22, for example, establishes an XYZ orthogonal coordinate system (world coordinate system) in which an X axis represents an axis that is parallel with the front side of the detected packaging box body 20, a Y axis represents an axis that is parallel with one side, of the upper surface of the packaging box body 20, orthogonal to the X axis, a Z axis represents a direction that is normal to the upper surface, and the origin represents the front left corner of the bottom surface of the detected packaging box body 20.

The acquisition unit 22 further acquires information about the size of the packaging box body 20. This size of the packaging box body 20 refers to the size of the packaging box body 20 in a real space (hereinafter, referred to as real size). Information about the real size may be acquired by the above-mentioned widely-known three-dimensional measurement process.

In one example of the present embodiment, a code image M is formed on the packaging box body 20. Therefore, if real size information indicating the real size of the packaging box body 20 is encoded into the code image M, the acquisition unit 22 may acquire information about the size of the packaging box body 20 by detecting the code image M from image data and decoding the code image M.

In the present example, it is assumed that information regarding the real size of the packaging box body 20 indicating the width (W: the length of a side in the X-axis direction), the depth (D: the length of a side in the Y-axis direction), and the height (H: the length of a side in the Z-axis direction), is acquired as the information about the size of the packaging box body 20.

The acquisition unit 22 according to the present embodiment further acquires the size (the number of pixels) of the packaging box body 20 in the image data. Hereinafter, the size in the image data is referred to as "virtual size" so as to be distinguished from the size in the real space.

The acquisition unit 22 selects, as a concerned width side, one of sides parallel with the width direction (X-axis direction) of the packaging box body 20 from the captured image data, and obtains, as the length in the width direction of the virtual size, the length (the number of pixels) w of the concerned width side. Also, the acquisition unit 22 selects, as a concerned depth side and a concerned height side, one of sides parallel with the depth direction (Y-axis direction) of the packaging box body 20 and one of sides in the height direction (Z-axis direction) of the packaging box body 20, respectively, from the captured image data, and obtains, as the lengths in the depth direction and the height direction of the virtual size, the length (the number of pixels) d of the concerned depth side and the length (the number of pixels) h of the concerned height side.

It is to be noted that selection of the concerned width side, the concerned depth side, and the concerned height side may be made on a prescribed condition such that the longest sides in the width direction is defined as the concerned width side, for example.

The estimation unit 23 estimates the real size of the article 30 included in the captured image on the basis of information about the size (real size) of the packaging box body acquired by the acquisition unit 22 and the image data acquired as a result of image capturing.

The estimation unit 23 generates information indicating a hexahedron (a cuboid bounding box) circumscribing the detected article 30 or including the detected article 30, and acquires the size (real size) of the bounding box by the above-mentioned three-dimensional measurement process. That is, the estimation unit 23 receives, from the acquisition unit 22, information regarding the real size (W (width), D (depth), H (height)) and the virtual size (w, d, h) of the packaging box body 20. Further, the estimation unit 23 acquires information regarding the virtual size (wt, dt, ht) of the bounding box including the article 30 acquired from the image data acquired as a result of image capturing.

Then, the estimation unit 23 obtains the ratios (rw, rd, rh) of the real size and the virtual size of the packaging box body 20. Here, it is assumed as follows.

$$rw=W/w$$

$$rd=D/d$$

$$rh=H/h$$

The estimation unit 23 obtains the real size (Wt, Dt, Ht) of the bounding box including the article 30, as follows.

$$Wt=rw\times wt$$

$$Dt=rd\times dt$$

$$Ht=rh\times ht$$

In the above-mentioned manner, the estimation unit 23 according to the present embodiment estimates the real size of the article 30, which is relatively small, by using the real size and virtual size of the packaging box body 20, which is a relatively large object, and the virtual size of the article 30. Accordingly, the real size of the article 30 which is a relatively small object can be obtained with relatively high precision, while a large error could be generated by the three-dimensional measurement process.

It is to be noted that the acquisition unit 22 may adopt, as the three-dimensional measurement process, a known method described in "J. Xiao, R. Bryan and T. Antonio, 'Localizing 3D cuboids in single-view images.' Advances in neural information processing systems 25 (2012)," for example. The acquisition unit 22 may abstract the shape of the article 30 by converting the article 30 to an object having a simple geometric shape such as the above-mentioned bounding box, examples of which include a cube, a rectangular parallelepiped shape (cuboid), a cylindrical column, a hollow cylindrical column, a cone, a torus, a triangular prism, a triangular pyramid, a quadrangular pyramid, a hexagonal prism, a hexagonal pyramid, a sphere, a hemisphere, or an ellipsoid, and may determine the size of the article 30 on the basis of the size of the abstracted object. The acquisition unit 22 determines the size of the article 30 abstracted as an object having a simple geometric shape, further on the basis of measurement reference information (metric information) acquired by the use of one or more code images M. The term "abstract" refers to determining a size and a geometric shape to circumscribe or include a target object (e.g. the article 30). It is to be noted that the acquisition unit 22 may infer and determine the abstracted object by inputting the feature point group on at least the article 30 into a learned machine learning model.

Alternatively, the acquisition unit 22 may determine the size of the article 30 by recognizing the shape of the article 30, on the basis of a point group, a measurement point group, and/or a three-dimensional point group on the article 30. Here, the acquisition unit 22 may determine the point group on the article 30, on the basis of sensing data acquired by a sensing unit such as a laser scanner, a depth sensor, or a Time of Flight (ToF) sensor. In addition, the acquisition unit 22 may recognize the shape of the article 30 by inputting the point group to a learned machine learning model such as PointNet, VoteNet, VoxelNet, or PointPillars. The acquisition unit 22 determines the size of the article 30, further on the basis of the measurement reference information acquired by the use of one or more code images M.

Further, the acquisition unit 22 may determine the size of the article 30 by simultaneously performing estimation of the self-position of the information processing apparatus 10 including the imaging unit 15 and creation of an environment map by Simultaneous Localization and Mapping (SLAM). The acquisition unit 22 of this example may simultaneously perform the estimation of the self-position and the creation of an environment map, further on the basis of sensing data acquired by a sensing unit such as a laser scanner, a depth sensor, or a ToF sensor. In addition, the acquisition unit 22 may determine the size of the article 30 by simultaneously performing the estimation of the self-position and creation of an environment map, further on the basis of the measurement reference information acquired by the use of one or more code images M.

Alternatively, the acquisition unit 22 may determine the size of the article 30, on the basis of data on a plurality of sequentially captured images or may determine the size of the article 30, on the basis of data on a single captured image (one shot). In a case where image data acquired by the imaging unit 15 having a monocular camera form to determine the size of the article 30 is used, the acquisition unit 22 may determine the size of the article 30 by determining the distance in the depth direction near the article 30 with use of a monocular depth estimation model such as monodepth, monodepth2, or SfM Learner. In this case, the acquisition unit 22 may determine the size of the article 30, further on the basis of measurement reference information acquired by the use of one or more code images M.

The trading process unit 24 applies information regarding the size (real size) of the article 30 estimated by the estimation unit 23 to a prescribed process concerning trading of the article 30. In one example, the trading process unit 24 encourages a user to log in to an e-commerce site, and, after the user logs in to the e-commerce site, the trading process unit 24 asks the user to input the name, etc. of the article 30 which is offered for sale. After the user inputs the name, etc. of the article 30, the trading process unit 24 sends information regarding the real size of the article 30 estimated by the estimation unit 23 as well as the information inputted by the user to the server of the e-commerce site, so that the sent information is registered as information concerning an e-commerce object. The registered information is provided to a trading requester (purchase requester) in the e-commerce so as to be used for the trading. A description of a process example of this trading will be given later.

Operation Example

An example of the information processing apparatus 10 according to the present embodiment, which has the above-mentioned configuration, operates as follows. The user of the information processing apparatus 10 puts the article 30 which is an e-commerce object, close to the packaging box body 20 which is used to pack the article 30 for shipping, and captures an image that includes the article 30 and the packaging box body 20 by means of the information processing apparatus 10. The user sequentially performs the image capturing (scanning) while changing the position of the information processing apparatus 10 with respect to the packaging box body 20, etc.

In an example below, the upper surface T and four lateral surfaces of the packaging box body 20 are defined as target surfaces, and the code image M is formed on each of target surfaces. In this example, the code images M are two-dimensional bar codes. It is assumed that the bar codes are generated by encoding size information (information for identifying the lengths of the width W, the depth D, and the height H) indicating the real size of the packaging box body 20 on which the code images M are provided and identification information (BID) unique to the packaging box body 20.

Figure 5:
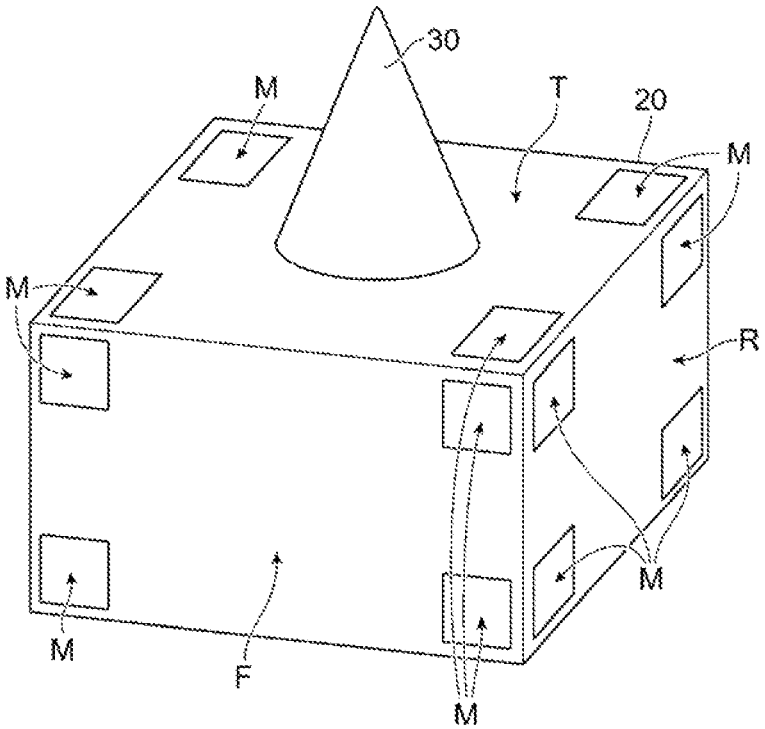
FIG. 5 is an explanatory diagram depicting an example with use of the packaging box body according to the embodiment of the present disclosure.

For example, the user puts the article 30 which is an e-commerce object, on the upper surface of the packaging box body 20, and captures an image that fully includes the packaging box body 20 and the entire article 30 by means of the information processing apparatus 10, as depicted in FIG. 5. The information processing apparatus 10 starts a process in FIG. 6, and detects, from data on the sequentially captured images, a feature point group on the captured subjects (the packaging box body 20 and the article 30). By using the detected feature point group, the information processing apparatus 10 detects the packaging box body 20 and the article 30 from the image data (S11).

Moreover, the information processing apparatus 10 establishes a coordinate system to indicate the three-dimensional space where the packaging box body 20 and the article 30 have been detected. Here, it is assumed that the coordinate system is established according to the shape of the detected article 30 such that, for example, the X axis, the Y axis, and the Z axis respectively indicate an axis that is parallel with the width (W) direction sides of the upper surface of the packaging box body 20, an axis that is parallel with the depth (D) direction sides, and a direction (height (H) direction) that is normal to the upper surface, as in the XYZ coordinate system depicted in FIG. 2.

Next, the information processing apparatus 10 acquires information about the real size and the virtual size of the packaging box body 20. In an example of the present embodiment, the information processing apparatus 10 detects a code image M from the captured image data and decodes the code image M (S13). In this example of the present embodiment, the code images M are formed on the target surfaces which are the upper surface T and the four lateral surfaces. Accordingly, irrespective of the direction in which the image capturing has been performed, the code image disposed on at least any one of the target surfaces can be detected.

The information processing apparatus 10 acquires information about the real size of the packaging box body 20, from information acquired by the decoding at step S13. In addition, the information processing apparatus 10 acquires the virtual size (the number of pixels) of the packaging box body 20 in the image data (S14).

In addition, the information processing apparatus 10 generates information that indicates a bounding box including the detected article 30 which is an e-commerce object, and acquires information regarding the virtual size (wt, dt, ht) of the bounding box.

By using the information acquired at steps S13 and S14, the information processing apparatus 10 obtains the ratios (rw, rd, rh) of the real size and the virtual size of the packaging box body 20, as follows.

$$rw=W/w$$

$$rd=D/d$$

$$rh=H/h$$

Then, the information processing apparatus 10 estimates the real size (Wt, Dt, Ht) of the bounding box including the article 30 (S16), as follows.

$$Wt=rw\times wt$$

$$Dt=rd\times dt$$

$$Ht=rh\times ht$$

After acquiring, at step S16, the real size of the bounding box including the article 30, which corresponds to the real size of the article 30, the information processing apparatus 10 accesses the server of the e-commerce site in accordance with a command additionally inputted by the user, so that the server manages information for identifying the user, information (e.g. the name of the article 30) about the article 30 which is an e-commerce object additionally inputted by the user, the identification information (BID) unique to the packaging box body 20 acquired at step S13, and the information about the real size of the article 30 estimated at step S16 in association with each other (S17: trading process).

[Process at e-Commerce Site Server]

From the information processing apparatus 10 owned by the user who sells the article 30, the server of the e-commerce site receives the information for identifying the user, the information about the article 30, the information about the real size of the article 30 estimated by the information processing apparatus 10, and the identification information unique to the packaging box body 20 which has been imaged with the article 30 by means of the information processing apparatus 10, and holds the information in association with each other.

When a purchase requester who has requested purchase of the article 30 accesses the server, the server provides the information about the article 30 and the information about the real size of the article 30. Upon receiving an instruction for purchase of the article 30, the server gives an instruction to ship the article 30, to the user identified by the information that is associated with the information about the article 30 corresponding to the instruction.

In accordance with this instruction, the user ships the article 30 packed by the packaging box body 20. Thereafter, when the purchase requester receives the article 30 with the packaging box body 20, the purchase requester takes a picture of the packaging box body 20 by using, for example, a smartphone owned by the purchase requester, and reads a code image M formed on the packaging box body 20, decodes the information indicated by the code image M, thereby acquires identification information unique to the packaging box body on which the code image M is formed. Subsequently, the purchase requester transmits the acquired identification information to the server of the e-commerce site by means of the smartphone, for example. Upon receiving the identification information regarding the packaging box body 20 from the purchase requester, the server of the e-commerce site recognizes that the reception is completed. Then, the server deletes the information for identifying the user, the information about the article 30, and the information about the real size of the article 30 estimated by the information processing apparatus 10, which are recorded in association with the received identification information.

According to the present embodiment, a purchase requester is allowed to see beforehand, as information about the article 30, information about a real size estimated by the information processing apparatus 10, and further, reception of the article 30 shipped by a seller can be confirmed with use of the identification information regarding the packaging box body 20. Therefore, it is possible to help a purchase requester participate safely in an e-commerce while a viewpoint of the purchase requester is taken into consideration.

[Another Example of Position where Code Image is Formed]

Figure 7:
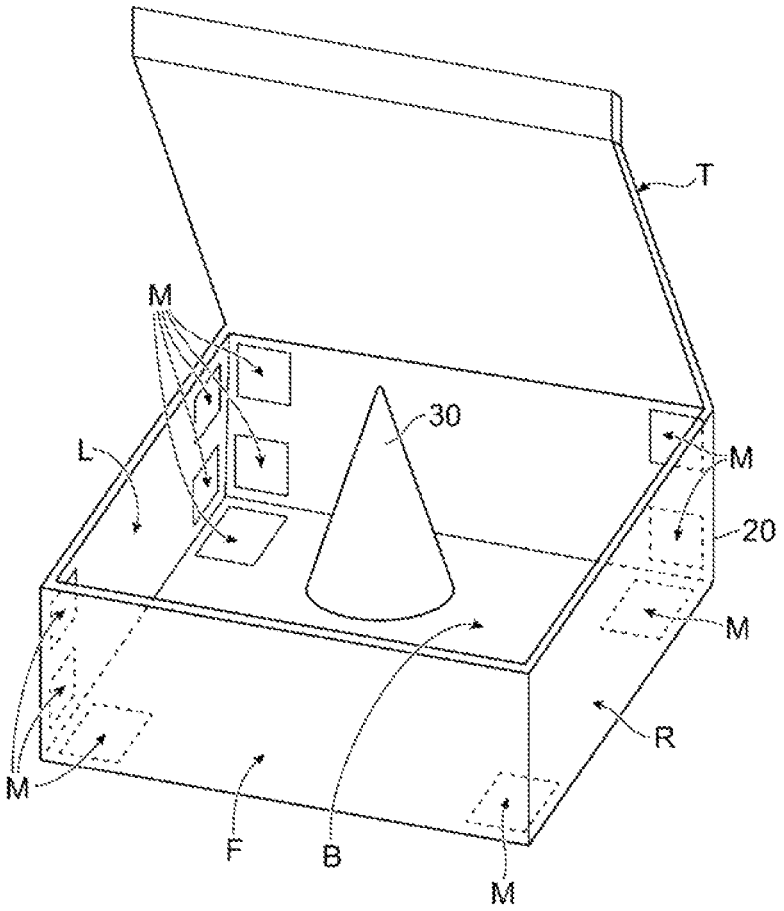
FIG. 7 is a schematic perspective view of another example of the packaging box body according to the embodiment of the present disclosure.

The code images M are disposed on the outer surface side of the packaging box body 20 in the above explanation. However, the present embodiment is not limited to this configuration. Specifically, the code images M may be disposed on the inner surface side of the packaging box body 20 (FIG. 7) in addition to the outer surface side of the packaging box body 20 or in place of the outer surface side (that is, without disposing any code images M on the outer surface side).

When the code images M are disposed on an inner surface side of the packaging box body 20, the inner bottom surface of the packaging box body 20 and at least two inner lateral surfaces that are adjacent to each other are defined as target surfaces, and the code image M is disposed on each of the target surfaces.

A user opens a lid surface of the packaging box body 20, puts the article 30 in the packaging box body 20, and captures an image that includes the packaging box body 20 and the article 30 by means of the information processing apparatus 10. The user sequentially performs the image capturing (scanning) while changing the position of the information processing apparatus 10 with respect to the packaging box body 20, etc.

In an example below, the inner bottom surface and four inner lateral surfaces of the packaging box body 20 are defined as target surfaces, and the code image M is formed on each of the target surfaces. Also in this example, the code images M are two-dimensional bar codes. It is assumed that the bar codes are generated by encoding size information (information for identifying the lengths of the width W, the depth D, and the height H) indicating the real size of the packaging box body 20 on which the code images M are provided and identification information (BID) unique to the packaging box body 20.

The information processing apparatus 10 detects a feature point group and detects the packaging box body 20 and the article 30 from image data by using the feature point group (step S11). Further, the information processing apparatus 10 establishes a coordinate system to indicate the three-dimensional space where the packaging box body 20 and the article 30 have been detected (step S12), and detects and decodes a code image M to acquire information about the real size of the packaging box body 20 (step S13). In addition, the information processing apparatus 10 acquires the virtual size of the packaging box body 20 from image data acquired by image capturing. In this example, information about the real size encoded into a code image M indicates the width W, the depth D, and the height H (internal dimensions) of the inner surfaces of the packaging box body 20. The information processing apparatus 10 acquires the virtual size (the number of pixels) w in the width direction, the virtual size (the number of pixels) d in the depth direction, and the virtual size (the number of pixels) h in the height direction of an inner surface of the packaging box body 20 (step S14) by taking advantages of the information of the detected feature point group.

In addition, the information processing apparatus 10 generates information that indicates a bounding box including the article 30 which is an e-commerce object, and acquires information about the virtual size (wt, dt, ht) of the bounding box (step S15). Then, the information processing apparatus 10 estimates the real size (Wt, Dt, Ht) of the bounding box including the article 30 by executing step S16 which has been previously explained.

Also in this example, information about the estimated real size of the article 30 (the information about the bounding box) is applied to a prescribed trading process.

[Another Example (1) of Estimating Size of Article by Using Code Image]

In the explanation given so far, the information processing apparatus 10 is configured to estimate the real size of the article 30 by using information about the real size of the packaging box body 20 as information about the size of the packaging box body 20. However, the present embodiment is not limited to this case.

In another example of the present embodiment, the information processing apparatus 10 may use, as information about the size of the packaging box body 20, the distance along each axis X, Y, and Z (for example, LW, LD, LH in FIG. 2) between a pair of code images M of the code images M formed on each of the target surfaces of the packaging box body 20, in place of the real size of the packaging box body 20. As LW, LD, LH, the distance between the respective centers of the pair of code images may be used, as depicted in FIG. 2, or the distance between the facing sides of the pair of code images may be used, for example.

It is to be noted that information about the real distance between the code images M may be encoded into the code images M. In this case, the information processing apparatus 10 acquires the information by decoding any of the code images M. In this example, each code image M does not need to indicate any encoded information. A figure that is detectable to a computer may be simply used as a code image M. In this case, it is assumed that the real distance LW between the code images M in the width direction, the real distance LD between the code images M in the depth direction, and the real distance LH between the code images M in the height direction are prescribed known distances (predetermined).

In this example, the information processing apparatus 10 detects the packaging box body 20 and the article 30 at steps S11 and S12 in the process shown in FIG. 6, and subsequently, detects code images M formed on the packaging box body 20, and acquires, as information about the size of the packaging box body 20, the distance (the number of pixels) Lw between the code images M in the width direction in the image data, the distance (the number of pixels) Ld between the code images M in the depth direction in the image data, the distance (the number of pixels) Lh between the code images M in the height direction in the image data.

Then, the information processing apparatus 10 obtains the ratios (r'w, r'd, r'h) between the real distance between the code images formed on the packaging box body 20 and the corresponding distance in the image data, as follows.

$$r'w=LW/Lw$$

$$r'd=LD/Ld$$

$$r'h=LH/Lh$$

The information processing apparatus 10 generates information that indicates a bounding box including the article 30 which is an e-commerce object, and acquires information about the virtual size (wt, dt, ht) of the bounding box (step S15). Then, the information processing apparatus 10 estimates the real size (Wt, Dt, Ht) of the bounding box including the article 30 by executing a process that is similar to step S16 in FIG. 6, as follows.

$$Wt=r'w\times wt$$

$$Dt=r'd\times dt$$

$$Ht=r'h\times ht$$

Also in this example, information about the estimated real size of the article 30 (the information about the bounding box) is applied to a prescribed trading process.

In this example of the present embodiment, it is preferable to form the code images M on each surface of the packaging box body 20 in such a way that a pair of code images M are disposed in each of the directions that are along at least three sides (the X-axis direction, the Y-axis direction, the Z-axis direction) of the surface that are orthogonal to one another.

[Still Another Example (2) of Estimating Size of Article by Using Code Image]

In still another example of the present embodiment, the information processing apparatus 10 may use, as information about the size of the packaging box body 20, information about the size of a code image M formed on each of the target surfaces of the packaging box body 20, in place of the real size of the packaging box body 20. In a certain example of the present embodiment, the code images M each have a square shape.

The real size (longitudinal/lateral size L) of a code image M may be encoded into the code image M. In this case, the information processing apparatus 10 acquires the information by decoding the code image M. Also in this example, each code image M does not need to indicate any encoded information. A figure that is detectable to a computer may be simply used as a code image M. In this case, it is assumed that the real size (size L) of the code image M is already known as a prescribed size (preset size).

In this example, the information processing apparatus 10 detects the packaging box body 20 and the article 30 at steps S11 and S12 in FIG. 6, and subsequently, detects code images M formed on the packaging box body 20, and acquires, as information about the size of the packaging box body 20, the distance (the number of pixels) 1 between the code images M in the lateral direction or the longitudinal direction on each surface.

Then, the information processing apparatus 10 obtains the ratios (r"w, r"d, r"h) between the real distance between the code images formed on the packaging box body 20 and the corresponding distance in the image data, as follows.

$$r''w=L/l$$

$$r''d=L/l$$

$$r''h=L/l$$

The information processing apparatus 10 generates information that indicates a bounding box including the article 30 which is an e-commerce object, and acquires information about the virtual size (wt, dt, ht) of the bounding box (step S15). Then, the information processing apparatus 10 estimates the real size (Wt, Dt, Ht) of the bounding box including the article 30 by executing a process that is similar to step S16 in FIG. 6, as follows.

$$Wt=r'w\times wt$$

$$Dt=r'd\times dt$$

$$Ht=r'h\times ht$$

Also in this example, information about the estimated real size of the article 30 (the information about the bounding box) is applied to a prescribed trading process.

[Example of Estimating Size of Article without Using Code Image]

In a yet another example of the present embodiment, the information processing apparatus 10 estimates the size of the article 30 without using any code image. In the present example, the information processing apparatus 10 acquires information about the real size of the packaging box body 20 as information about the size of the packaging box body 20, by a three-dimensional measurement process.

For example, through planar surface recognition of the three-dimensional measurement process, the information processing apparatus 10 recognizes which surface (the upper surface T, the front surface F, and the right lateral surface R or left lateral surface L) of the packaging box body 20 has been imaged. Then, on the basis of the position of the recognized packaging box body 20 in the XYZ orthogonal coordinate system, the width direction length WT and the depth direction length DT of the upper surface T, and/or the width direction length WF and the height direction length DT of the front surface F, and/or the depth direction length DS and the height direction length HS of the lateral surface are acquired. The lengths acquired here are the real lengths.

Then, the information processing apparatus 10 estimates the real size (W, D, H) of the packaging box body 20 as follows.

$$W=WF \text{ (or } W=WT\text{, or } W=(WF+WT)/2)$$

$$D=DT \text{ (or } D=DS\text{, or } D=(DT+DS)/2)$$

$$H=HF \text{ (or } H=HS\text{, or } H=(HF+HS)/2)$$

In addition, in this example, the information processing apparatus 10 acquires the ratios (rw, rd, rh) of the real size and the virtual size of the packaging box body 20 by using the virtual size (the number of pixels) (w, d, h) of the packaging box body 20 in the image data, as follows.

$$rw=W/w$$

$$rd=D/d$$

$$rh=H/h$$

Further, the information processing apparatus 10 estimates the real size (Wt, Dt, Ht) of the bounding box including the article 30 by executing step S16 in FIG. 6, as follows.

$$Wt=rw\times wt$$

$$Dt=rd\times dt$$

$$Ht=rh\times ht$$

In this example of the present embodiment, it is not necessary to form a code image on the packaging box body 20. That is, a box body made of a normal corrugated cardboard can be used.

[Example of Requiring User to Perform Work]

Figure 8:
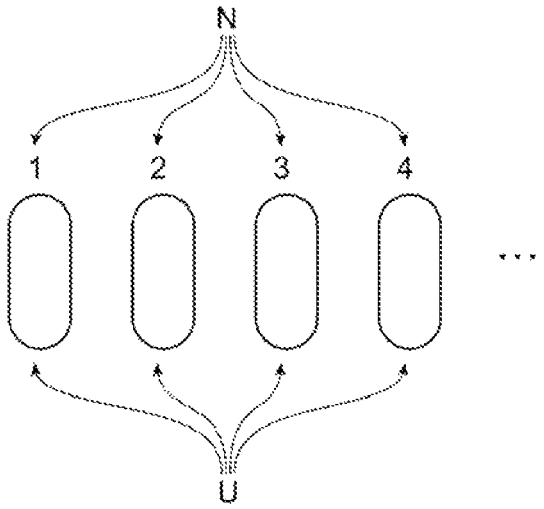
FIG. 8 is an explanatory diagram depicting an entry field that is formed on the packaging box body according to the embodiment of the present disclosure.

In the present embodiment, an entry field into which a user can write computer-readable information may be formed on an outer or inner surface of the packaging box body 20. The entry field includes a plurality of frames U that can be filled by a user, as depicted in FIG. 8. In addition, identification information (number N in FIG. 8) for identifying the respective frames U may be formed near the corresponding frames U so as to be respectively associated with the frames U.

Figure 6:
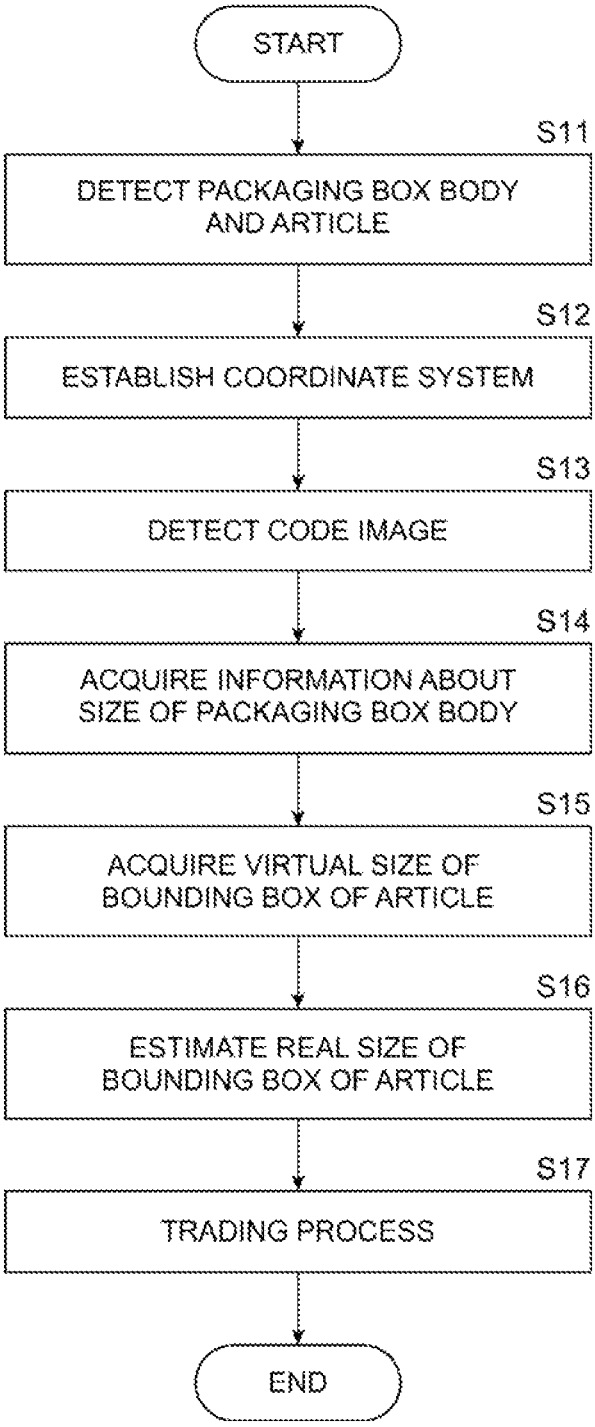
FIG. 6 is a flowchart depicting an operation example of the information processing apparatus according to the embodiment of the present disclosure.

In a case where the packaging box body 20 provided with the entry field is used, the information processing apparatus 10 randomly issues identification information that is formed with the entry field, before executing the process shown in FIG. 6, for example. Accordingly, the user is guided to fill the frame U corresponding to the issued identification information.

After the user fills the frame U corresponding to the issued identification information in accordance with the guidance to proceed with the process in the information processing apparatus 10, the information processing apparatus 10 offers, to the user, guidance for image capturing of the packaging box body 20 with the article 30.

In accordance with the guidance, the user starts image capturing of the article 30 disposed on the packaging box body 20, for example. Thereafter, the user continues the image capturing while changing the position and the visual direction of (the imaging unit 15 of) the information processing apparatus 10. Accordingly, the information processing apparatus 10 acquires information about the real size of the packaging box body 20, etc., and further, recognizes which frame U on the entry field is filled.

This recognition is similar to mark sheet (computer readable answer card) recognition, which has been widely known. Thus, an explanation of the recognition process will be omitted.

As a result of the recognition, the information processing apparatus 10 determines whether or not the identification information in the filled frame U matches the identification information previously issued by the information processing apparatus 10 itself. If the matching is determined, the information processing apparatus 10 proceeds with the process to estimate the real size of the article 30 or execute a process concerning selling.

On the other hand, when it is determined that the identification information in the filled frame U does not match the identification information previously issued by the information processing apparatus 10 itself, the process is suspended. Alternatively, the user may be informed that a correct frame is not filled, and then, the process may be terminated.

According to this example, the article 30 can be prevented from being erroneously shipped in an incorrect packaging box body 20 (for example, a box identical to that used in a past purchase of the article 30) that is different in the real size from the packaging box body 20 used to measure the real size.

[Still Another Application of Code Image]

In the explanation given so far, the code images M are used to acquire information about the size of the packaging box body 20. In another example of the present embodiment, however, the information processing apparatus 10 may use the code images M to recognize the surfaces of the packaging box body 20. Alternatively, the information processing apparatus 10 may use the code images M to detect the packaging box body 20 itself.

It should be understood by those skilled in the art that various modifications, combinations, sub-combinations and alterations may occur depending on design requirements and other factors insofar as they are within the scope of the appended claims or the equivalents thereof.

What is claimed is:

1. An information processing apparatus comprising:

at least one memory configured to store computer program code; and at least one processor configured to read the program code and operate as instructed by the program code, the program code comprising:

capturing code configured to cause at least one of the at least one processor to capture an image that includes a packaging box body and an article;

first obtaining code configured to cause at least one of the at least one processor to obtain, based on the captured image, a feature point group corresponding to the article;

second obtaining code configured to cause at least one of the at least one processor to obtain, based on inputting the feature point group into a pre-trained machine learning model, an abstracted object with a shape corresponding to an abstracted shape of the article; and estimating code configured to cause at least one of the at least one processor to estimate, based the abstracted object, a size of the article, wherein information regarding the estimated size of the article is applied to a prescribed process concerning trading of the article, wherein, in the packaging box body, at least two lateral surfaces that are adjacent to each other are defined as target surfaces, and a code image is formed on each of the target surfaces, and wherein the estimating code is configured to cause at least one of the at least one processor to:

acquire information about the size of the article by using the code images formed on the target surfaces of the packaging box body on a basis of the captured image; and estimate the size of the article based on a ratio between:

a first size of the packaging box body obtained based on at least one code image in the captured image, and a second size of the packaging box body in pixels in the captured image.

2. The information processing apparatus according to claim 1, wherein the code image is of a predetermined size, and wherein the estimating code is configured to cause at least one of the at least one processor to estimate the size of the article based on a ratio between:

the predetermined size of the code image, and a size of the packaging box body in pixels in the captured image.

3. The information processing apparatus according to claim 1, wherein a plurality of code images are formed on the target surfaces, wherein, at least one pair of code images among the plurality of code images are separated by a predetermined determined distance, and wherein the estimating code is configured to cause at least one of the at least one processor to estimate the size of the article based on a ratio between:

the predetermined distance between the at least one pair of code images, and a size of the packaging box body in pixels in the captured image.

4. The information processing apparatus according to claim 1, wherein the code image includes encoded information regarding an electronic signature, wherein the program code further comprises verification code configured to cause at least one of the at least one processor to obtain a verification result value based on verifying the electronic signature, and wherein the estimating code is configured to cause at least one of the at least one processor to estimate the size of the article based on the verification result corresponding to a first value.

5. The information processing apparatus according to claim 1, wherein the shape of the abstracted object comprises one from among a cube, a rectangular parallelepiped shape, a cylindrical column, a hollow cylindrical column, a cone, a torus, a triangular prism, a triangular pyramid, a quadrangular pyramid, a hexagonal prism, a hexagonal pyramid, a sphere, a hemisphere, or an ellipsoid.

* * * * *